US008307470B2

(12) United States Patent
Abadi

(10) Patent No.: US 8,307,470 B2
(45) Date of Patent: Nov. 13, 2012

(54) TOILET FLUSHING WITHOUT USING A TOILET TANK

(75) Inventor: Nir Abadi, Haifa (IL)

(73) Assignees: Oved Abadi, Haifa (IL); Mira Asraf, Haifa (IL); Nir Abadi, Haifa (IL)

( * ) Notice: Subject to any disclaimer, the term of this patent is extended or adjusted under 35 U.S.C. 154(b) by 327 days.

(21) Appl. No.: 12/446,236

(22) PCT Filed: Oct. 23, 2007

(86) PCT No.: PCT/IL2007/001272

§ 371 (c)(1),
(2), (4) Date: Apr. 19, 2009

(87) PCT Pub. No.: WO2008/050324

PCT Pub. Date: May 2, 2008

(65) Prior Publication Data

US 2010/0319117 A1 Dec. 23, 2010

Related U.S. Application Data

(60) Provisional application No. 60/862,615, filed on Oct. 24, 2006.

(51) Int. Cl.
*E03D 5/10* (2006.01)

(52) U.S. Cl. ..... 4/406; 4/434

(58) Field of Classification Search ..... 4/313, 406, 4/434–442

See application file for complete search history.

(56) References Cited

U.S. PATENT DOCUMENTS

| | | | | | |
|---|---|---|---|---|---|
| 2,858,546 | A | * | 11/1958 | Tekenos et al. | 4/313 |
| 3,497,876 | A | * | 3/1970 | Williams | 4/305 |
| 3,505,689 | A | * | 4/1970 | Neff et al. | 4/367 |
| 3,908,204 | A | * | 9/1975 | Hopkins | 4/406 |
| 3,965,492 | A | * | 6/1976 | Hendricks | 4/422 |
| 4,032,822 | A | * | 6/1977 | Un | 361/205 |
| 4,203,173 | A | * | 5/1980 | Morris et al. | 4/427 |
| 4,392,260 | A | * | 7/1983 | Bensen | 4/324 |
| 4,585,562 | A | * | 4/1986 | De Graw et al. | 210/805 |
| 4,783,859 | A | * | 11/1988 | Rozenblatt et al. | 4/316 |
| 4,918,764 | A | * | 4/1990 | Haselswerdt et al. | 4/406 |
| 5,036,553 | A | * | 8/1991 | Sanderson | 4/313 |
| 5,052,060 | A | * | 10/1991 | Makita et al. | 4/300 |
| 5,187,818 | A | * | 2/1993 | Barrett et al. | 4/313 |
| 5,201,082 | A | * | 4/1993 | Rockwell | 4/665 |
| 5,245,710 | A | * | 9/1993 | Haselswerdt et al. | 4/319 |
| 5,317,763 | A | * | 6/1994 | Frank et al. | 4/434 |
| 5,495,626 | A | * | 3/1996 | Lindroos et al. | 4/435 |
| 5,557,810 | A | * | 9/1996 | Antos et al. | 4/321 |
| 5,732,417 | A | * | 3/1998 | Pondelick et al. | 4/427 |
| 5,983,414 | A | * | 11/1999 | Lindroos et al. | 4/435 |
| 6,018,827 | A | * | 2/2000 | Shaw et al. | 4/664 |
| 6,136,184 | A | * | 10/2000 | King | 210/136 |
| 6,332,229 | B1 | * | 12/2001 | O'Malley et al. | 4/438 |

(Continued)

FOREIGN PATENT DOCUMENTS

CN 2510555 9/2002

(Continued)

*Primary Examiner* — Robert Canfield
(74) *Attorney, Agent, or Firm* — Mark M. Friedman

(57) ABSTRACT

A toilet bowl system comprising an electric spigot, an electric valve, and a control unit for controlling said electric spigot and said electric valve, and for operatively synchronizing said electric spigot with said electric valve.

7 Claims, 9 Drawing Sheets

U.S. PATENT DOCUMENTS

| | | | | |
|---|---|---|---|---|
| 6,397,405 | B1 * | 6/2002 | Grech et al. | 4/420 |
| 6,584,623 | B2 * | 7/2003 | Grech et al. | 4/434 |
| 6,804,840 | B2 * | 10/2004 | Berman | 4/434 |
| 6,871,361 | B2 * | 3/2005 | Grech et al. | 4/252.5 |
| 6,883,188 | B2 * | 4/2005 | Sigler et al. | 4/434 |
| 6,934,976 | B2 * | 8/2005 | Parsons et al. | 4/378 |
| 6,981,285 | B2 * | 1/2006 | Sigler et al. | 4/434 |
| 7,069,604 | B2 * | 7/2006 | Tomita et al. | 4/406 |
| 7,225,478 | B2 * | 6/2007 | Lim et al. | 4/313 |
| 7,331,069 | B2 * | 2/2008 | Chu | 4/438 |
| 7,805,778 | B2 * | 10/2010 | Liao | 4/406 |
| 2003/0088910 | A1 * | 5/2003 | Hidetaka et al. | 4/425 |
| 2003/0101509 | A1 * | 6/2003 | Noburu et al. | 4/425 |
| 2003/0121092 | A1 * | 7/2003 | Sigler et al. | 4/434 |
| 2003/0229939 | A1 * | 12/2003 | Berman | 4/434 |
| 2004/0143893 | A1 * | 7/2004 | Wu et al. | 4/319 |
| 2008/0072372 | A1 * | 3/2008 | Jorsch et al. | 4/434 |
| 2010/0064424 | A1 * | 3/2010 | Hsu et al. | 4/304 |
| 2010/0064427 | A1 * | 3/2010 | Mehmet | 4/406 |
| 2010/0146694 | A1 * | 6/2010 | Teso | 4/431 |

FOREIGN PATENT DOCUMENTS

| | | | |
|---|---|---|---|
| CN | 2538873 | | 3/2003 |
| CN | 2672179 | | 1/2005 |
| JP | 1-299929 | * | 12/1989 |
| JP | 8-319650 | * | 12/1996 |
| JP | 2005-83085 | * | 3/2005 |
| JP | 2011-202374 | * | 10/2011 |

* cited by examiner

SECTION A-A

TOILET FLUSHING WITHOUT USING A TOILET TANK

FIELD OF THE INVENTION

The present invention relates to flushing systems for toilet bowls and more particularly, the present invention relates to a novel system and method for flushing a toilet bowl with no need for a tank reservoir and a siphon. The novel system utilizes an electric spigot installed in the upper portion of the toilet bowl, controlling the flushing water inlet, and a synchronized electric valve placed at the exit end of the toilet bowl.

BACKGROUND OF THE INVENTION AND PRIOR ART

The most common prior art toilet bowl includes a water tank reservoir positioned above the toilet bowl, whereas when the water is released, gravity is used to flush the toilet bowl. There is no sealed valve at the exit end of the toilet bowl and a siphon structured is used to prevent the return of flush water and waste and to prevent odor. When a control handle is manually operated, water in the tank passes into a toilet bowl that may contain waste, to flush the waste through an upper trap and through a passage leading to a drain pipe. The water-filled upper trap prevents sewer gas from passing into the washroom.

Some prior art water tanks include water saver mechanisms to reduce the amount of water passed into the bowl in each flushing, and uses a smaller toilet bowl to enable the contents of the bowl to be flushed out using less water. Water saving tanks often include to mechanical switches, one for the full tank release and on for releasing a portion of the water stored in the tank. Flush tanks often suffer from leaks and dual flush toilet double the probability of leaking from a flush valve to occur.

The water tank further includes mechanism, including many moving parts, gaskets, etc., that often break down and thus requires maintenance.

BRIEF SUMMARY OF THE INVENTION

According to the teachings of the present invention, there is provided a toilet bowl system including an electric spigot, an electric valve place and a control unit. The electric spigot is typically installed in the upper portion of the toilet bowl, and is controlled by the control unit to provide flushing water into the bowl, which synchronizes the electric spigot with the electric valve placed at the lower, exit end of the toilet bowl. The electric spigot provides water, typically pressured, to flush to toilet bowl. The electric valve provides an outlet for the water in the toilet bowl, possibly including waste, to the sewage.

To operate the toilet bowl system of the present invention, the user activates the control unit, for example using a switch or wireless relay. The control unit opens the electric spigot for a predetermined period of time, thereby allowing water to enter the toilet bowl. The controller also opens the door of the electric valve, thereby providing an outlet for the water in the toilet bowl to flow out to the sewage. The door of the electric valve is opened for a predetermined period of time. After closing the door of the electric valve, the controller may open the electric spigot for a predetermined period of time, thereby allowing water to enter and stay in the toilet bowl.

According to embodiments of the present invention, the door of the electric valve is made of ferro-magnetic material and is opened and closed by an electromagnetic mechanism.

According to embodiments of the present invention, the magnetic force holding the magnetic door is set to open when a preset force is pushing said magnetic door from inside out. Hence when the quantity of water in the toilet bowl exceeds a pre determined value, the door opens to prevent water overflow of the toilet bowl.

Optionally, the toilet bowl system of the present invention further includes a remote control device, which enables the user to set one or more parameters of the control unit, such as the electric spigot and/or electric valve opening time.

BRIEF DESCRIPTION OF THE DRAWINGS

The present invention will become fully understood from the detailed description given herein below and the accompanying drawings, which are given by way of illustration and example only and thus not limitative of the present invention.

DETAILED DESCRIPTION OF THE INVENTION

Figure 1:
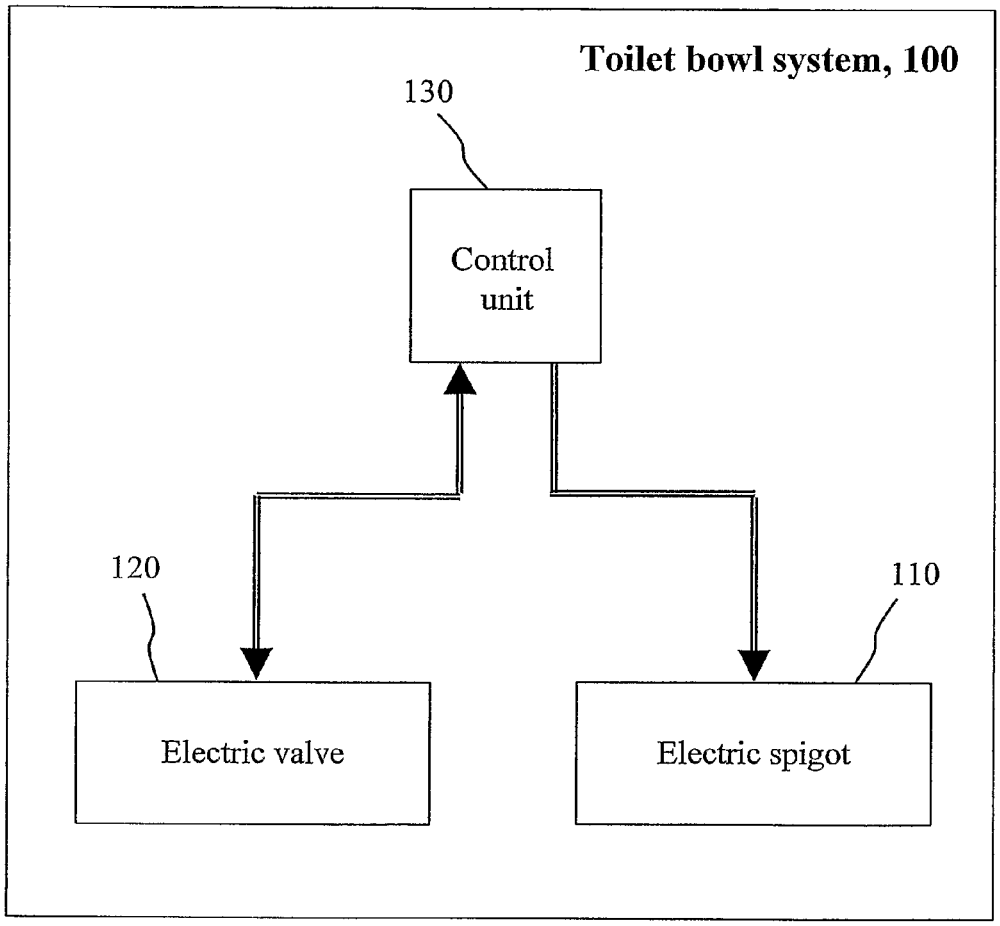
FIG. 1 is a schematic block diagram of a toilet bowl system, according to embodiments of the present invention.

The present invention is a toilet bowl system including an electric spigot, an electric valve place and a control unit. The electric spigot is typically installed in the upper portion of the toilet bowl, and is controlled by the control unit to provide flushing water into the bowl, which synchronizes the electric spigot with the electric valve placed at the lower, exit end of the toilet bowl.

Before explaining embodiments of the invention in detail, it is to be understood that the invention is not limited in its application to the details of design and the arrangement of the components set forth in the following description or illustrated in the drawings. The invention is capable of other embodiments or of being practiced or carried out in various ways. Also, it is to be understood that the phraseology and terminology employed herein is for the purpose of description and should not be regarded as limiting.

Referring now to the drawings, FIG. 1 is a schematic block diagram of a toilet bowl system 100, according to embodiments of the present invention. Toilet bowl system 100 includes an electric spigot 110, an electric valve 120 and a controller 130, that controls and synchronizes the operational activity of electric spigot 110 and electric valve 120.

Figure 2:
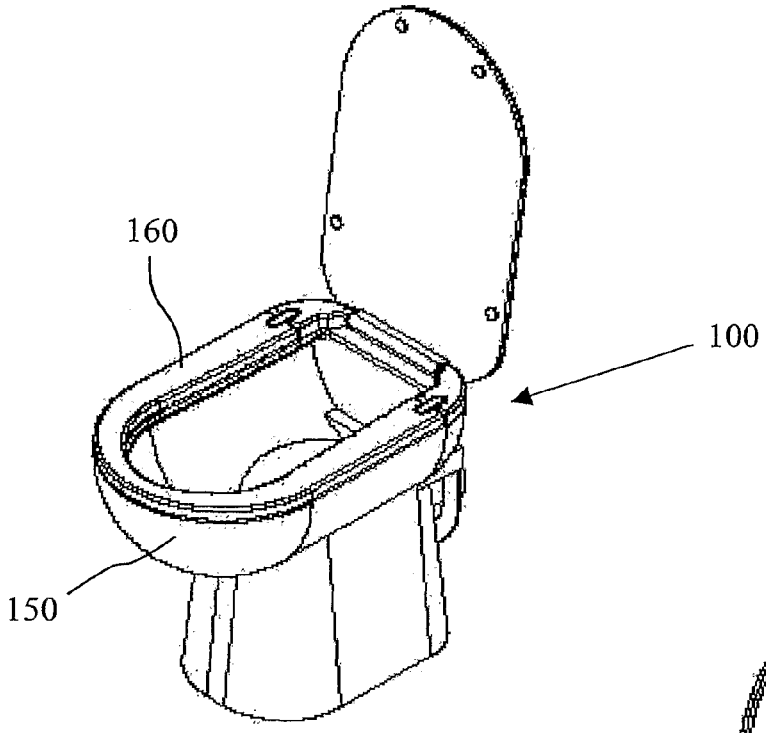
FIG. 2 is a front prospective view illustration of a toilet bowl system, according to embodiments of the present invention.
Figure 3:
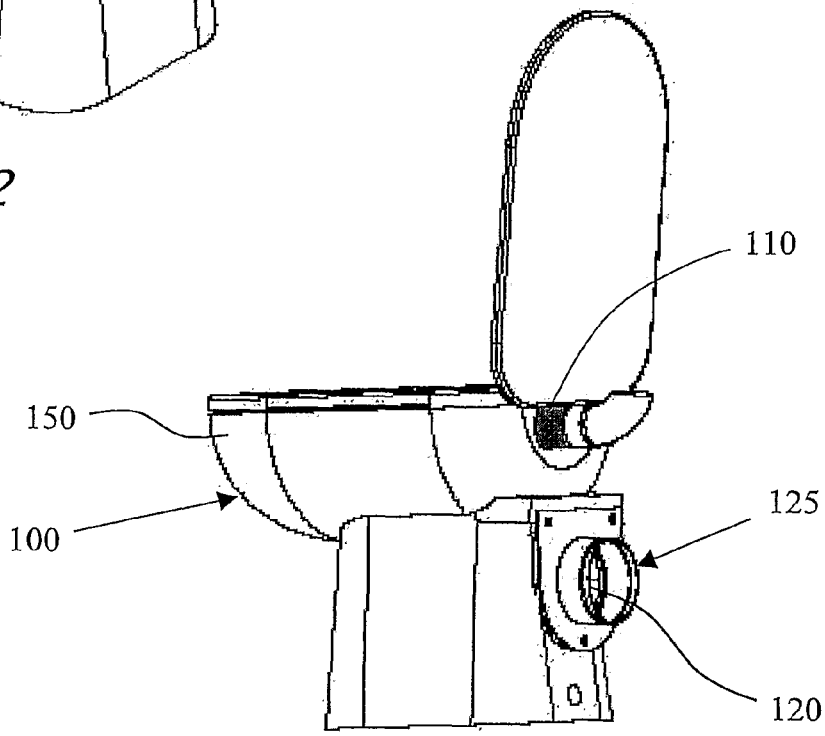
FIG. 3 is a back prospective view illustration of a toilet bowl system, according to embodiments of the present invention, whereas the door of the electric valve is in an open state.
Figure 4:
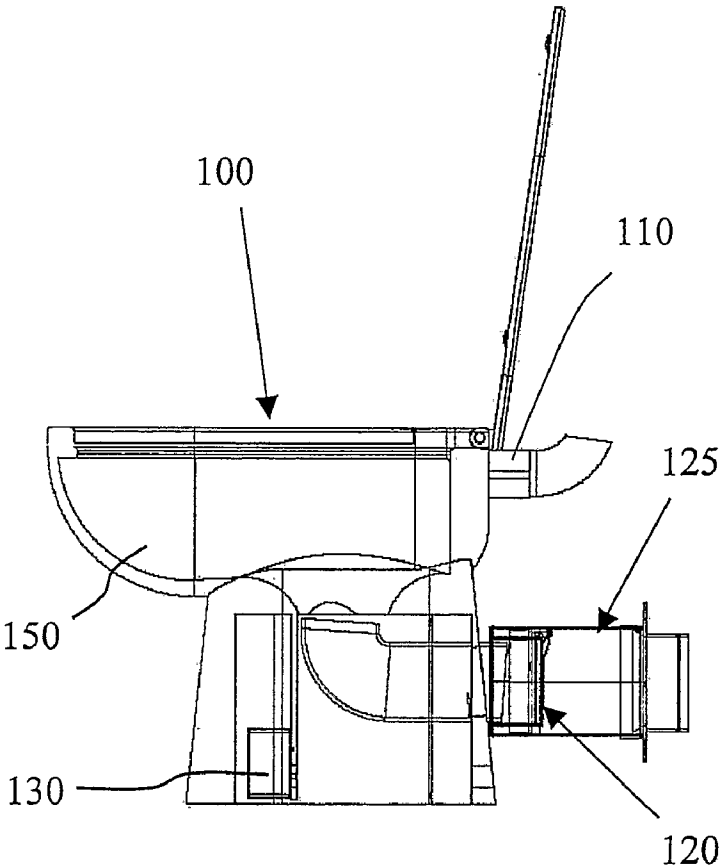
FIG. 4 is a side view illustration of a toilet bowl system, according to embodiments of the present invention, whereas the electric valve assembly is generally outside the bowl unit.
Figure 5:
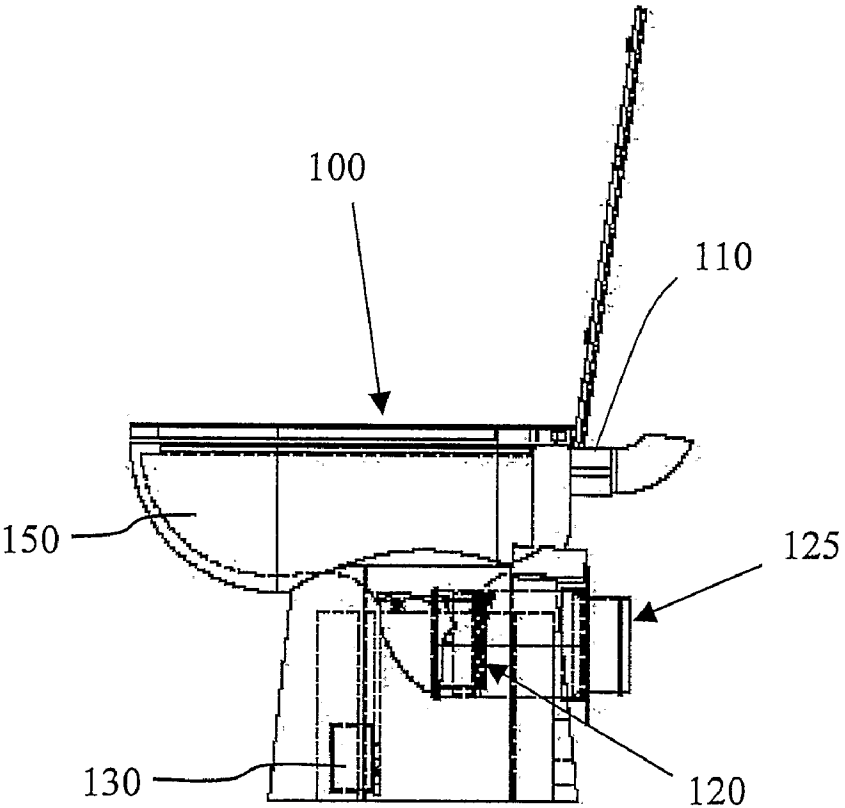
FIG. 5 is a side view illustration of a toilet bowl system, according to embodiments of the present invention, whereas the electric valve assembly is generally inside the bowl unit.
Figure 6:
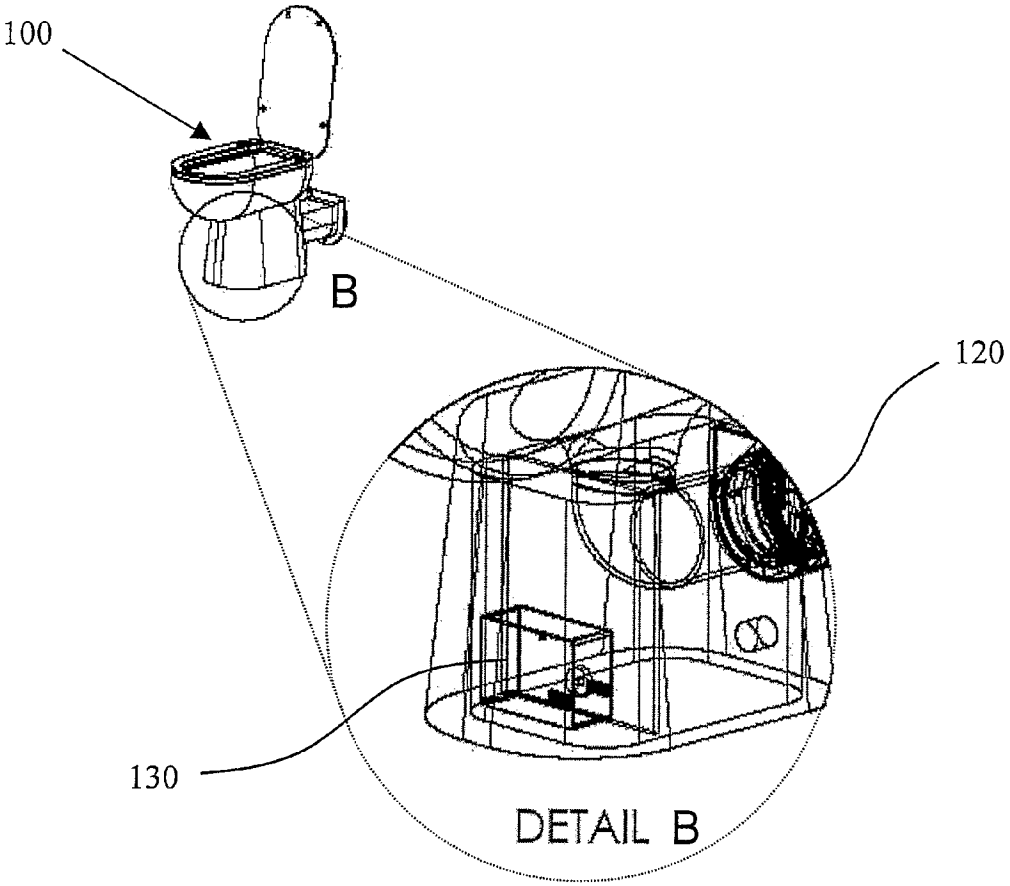
FIG. 6 is a side view illustration of a toilet bowl system, according to embodiments of the present invention, showing an example location of the control unit.

Reference is also made to FIGS. 2 and 3, which are, respectively, a front and back prospective view illustrations of a toilet bowl system 100, according to embodiments of the present invention. The toilet bowl body 150 and seat 160 the same as in ordinary, prior art toilet device and toilet bowl system 100 can be integrated into an ordinary, prior art toilet device. In FIG. 3, back housing part 125 of electric valve 120 is seen extending out of the exit pipe of toilet body 150. Reference is also made to FIGS. 4 and 5, which show side view illustrations of a toilet bowl system 100, according to embodiments of the present invention, whereas in FIG. 4 electric valve assembly 120 is generally integrated outside toilet bowl body 150, and in FIG. 5 electric valve assembly 120 is generally integrated inside toilet bowl body 150. Reference is also made to FIG. 6, which shows a side view illustration of a toilet bowl system 100, according to embodiments of the present invention, showing an example location of control unit 130.

Figure 7:
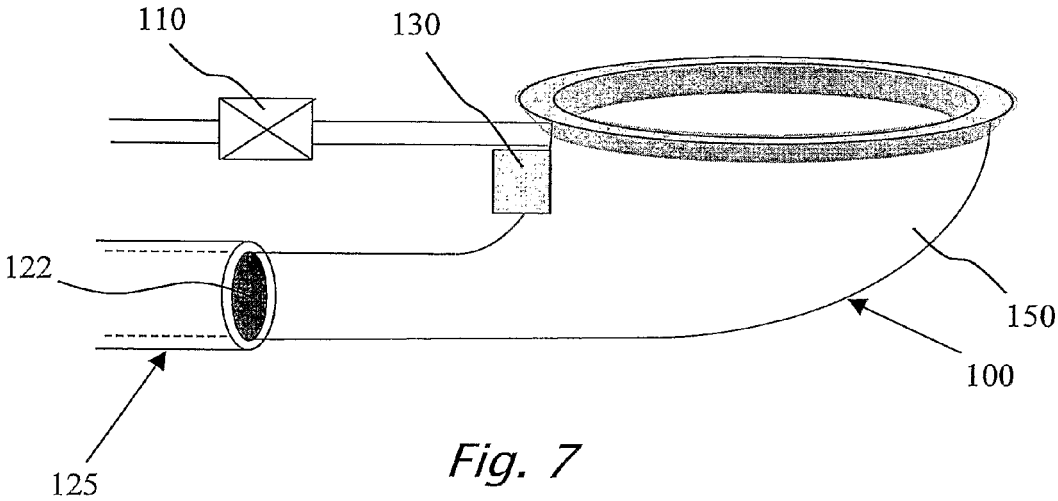
FIG. 7 is a side view schematic illustration of a toilet bowl system, according to embodiments of the present invention, whereas the door of the electric valve is in a close state.
Figure 8:
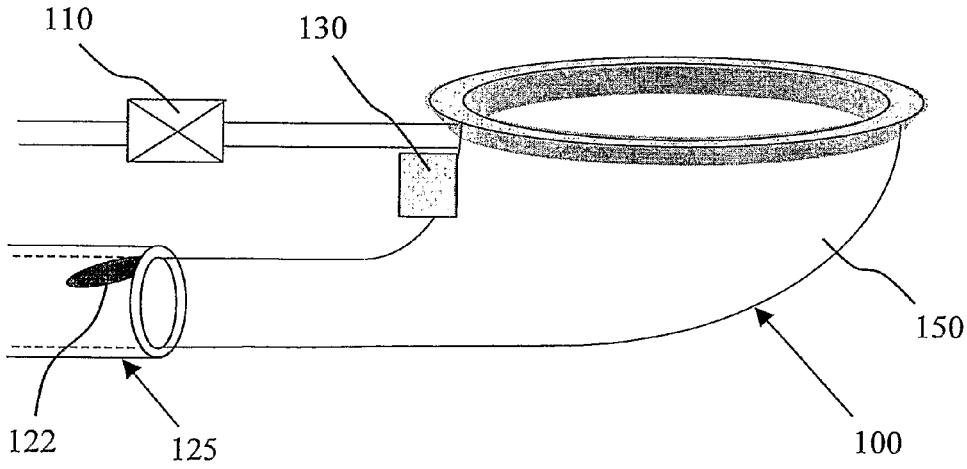
FIG. 8 is a side view schematic illustration of a toilet bowl system, according to embodiments of the present invention, whereas the door of the electric valve is in an open state.

It should be noted that a toilet body 150 of the present invention does not need a siphon mechanism to operate but can work as well with a toilet bowl 150 having a siphon mechanism. FIGS. 7 and 8 show side view schematic illustrations of a toilet bowl system 100, according to embodiments of the present invention, whereas toilet bowl 150 have no siphon mechanism.

To operate toilet bowl system 100, the user activates, for example using a switch or wireless relay, controller 130, which opens electric spigot 110 for a predetermined period of time, thereby allowing water to enter toilet bowl 150. Electric controller 130 also opens door 122 of electric valve 120, thereby providing an outlet for the water in toilet bowl 150 to flow out to the sewage. Door 122 of electric valve 120 is opened for a predetermined period of time.

In one embodiment of the present invention, controller 130 opens electric spigot 110 for a predetermined period of time, thereby allowing a predetermined quantity of water to enter toilet bowl 150. Then controller 130 closes electric spigot 110. Typically, the water entering the toilet bowl, are pressured water. The accumulated water including any possible waste are then released to the sewage, when controller 130 opens door 122 of electric valve 120 and closing door 122 after a predetermined period of time. FIG. 7 shows door 122 of electric valve 120 in a close state and FIG. 8 shows door 122 of electric valve 120 in an open state. Optionally, controller 130 opens electric spigot 110 for a predetermined period of time, thereby allowing a predetermined quantity of water to enter and stay at the bottom toilet bowl 150. Toilet bowl system 100 is now ready for the next operation cycle.

In another embodiment of the present invention, controller 130 opens electric spigot 110 for a predetermined period of time, thereby allowing a predetermined quantity of water to enter toilet bowl 150. Typically, the water entering the toilet bowl, are pressured water. The accumulated water including any possible waste are then released to the sewage, when controller 130 opens door 122 of electric valve 120 and closing door 122 after a predetermined period of time. Then controller 130 closes electric spigot 110 after allowing a predetermined quantity of water to enter and stay at the bottom toilet bowl 150. Toilet bowl system 100 is now ready for the next operation cycle. Optionally, controller 130 closes electric spigot 110 when closing electric valve 120.

Figure 9:
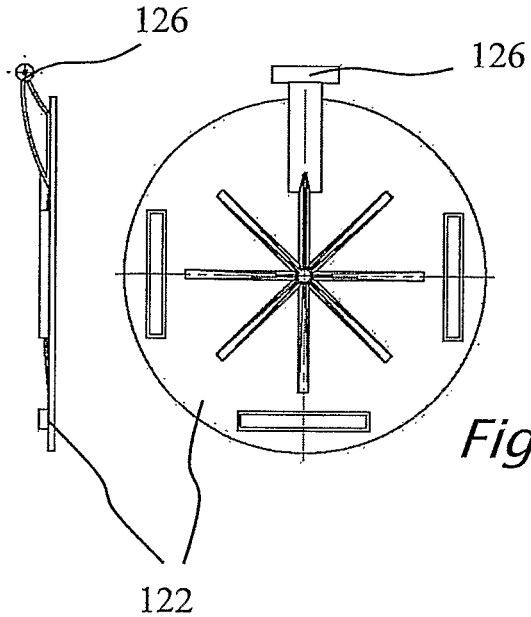
FIG. 9 is a side and front view illustrations of the door of an electric valve of a toilet bowl system, according to embodiments of the present invention, whereas the door is in a close state.
Figure 10A:
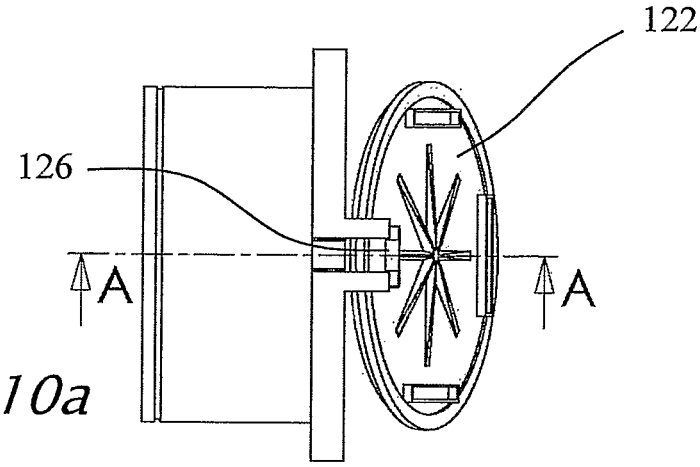
FIG. 10*a* is a top view illustration of the door of an electric valve of a toilet bowl system, according to embodiments of the present invention, whereas the door is in a partially open state.
Figure 10B:
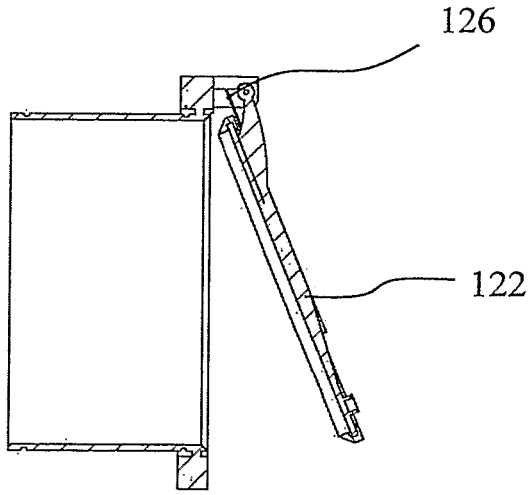
FIG. 10*b* is a cross section illustration of the door of an electric valve of a toilet bowl system, according to embodiments of the present invention, whereas the door is in a partially open state.

Reference is now made to FIG. 9, which shows a side and front view illustrations of door 122 of an electric valve 120 of a toilet bowl system 100, according to embodiments of the present invention, whereas door 122 is in a close state. Reference is also made to FIGS. 10*a* and 10*b*, which respectively show a top and a side, cross section A-A view illustrations of door 122 of an electric valve 120 of a toilet bowl system 100, according to embodiments of the present invention, whereas door 122 is in a semi open state. Door 122 opens about axis 126.

The mechanism for opening door 122 can be any electrical mechanism. One embodiment, using an electromagnetic field, will be described by way of example hereinafter, but other embodiments can be implemented within the scope of this invention, such as using an electrically-heated shape memory alloy, a stepper motor, etc.

Figure 11:
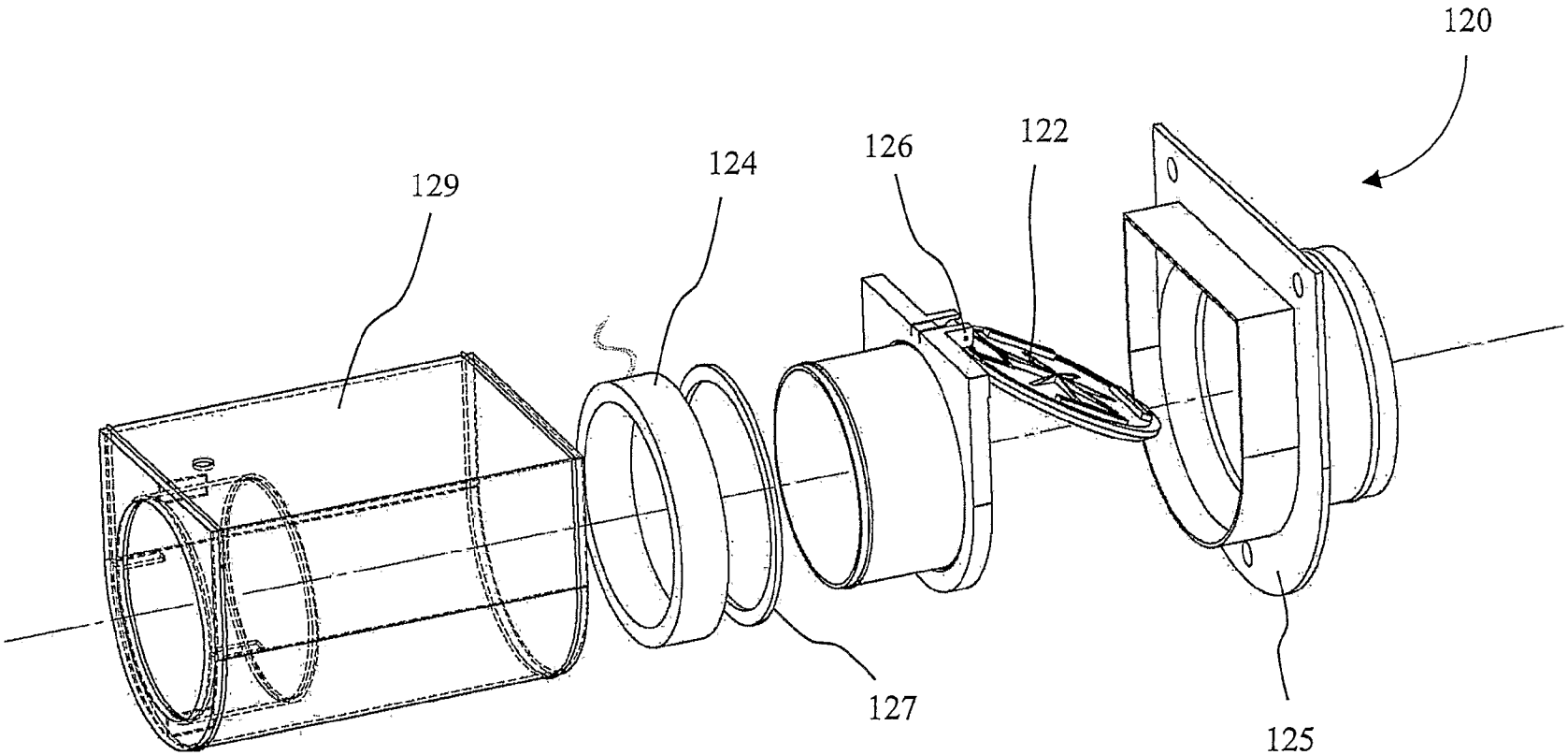
FIG. 11 is an exploded view illustration of an electric valve of a toilet bowl system, according to embodiments of the present invention.
Figure 12:
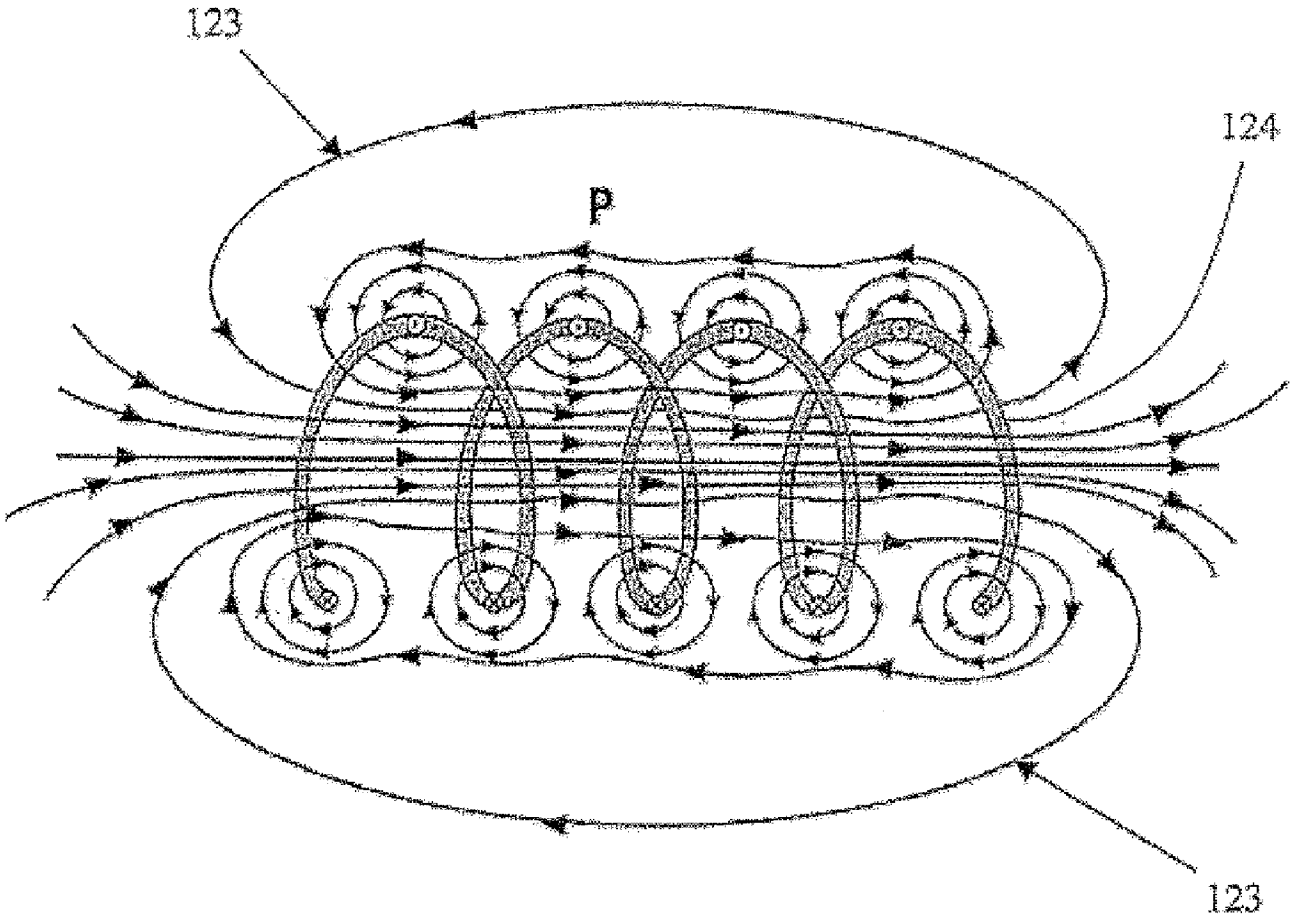
FIG. 12 is an example illustration of the magnetic field of a coil of an electric valve of a toilet bowl system, according to embodiments of the present invention.

Reference is also made to FIG. 11, which shows an exploded, side perspective view illustration of an electric valve assembly 120 of a toilet bowl system 100, according to embodiments of the present invention, whereas door 122 is in an open state. Electric valve 120 includes housing parts, adaptive to toilet bowl 150 and sewage pipe structure, such as back housing part 125 and back housing part 129. Typically, electric valve assembly 120 also includes parts to assure the sealing of the various parts of electric valve assembly 120, such as sealing gaskets. In embodiments of the present invention, electric valve assembly 120 also includes coil 124. When an electrical current flows in one direction, a magnetic field, having a certain polarity, is formed. When the current direction is reversed, the polarity of the magnetic field is inverted. FIG. 12 shows an example illustration of magnetic field 123 of coil 124 of an electric valve 120 of a toilet bowl system 100, according to embodiments of the present invention. At least a portion of door 122 is made of ferro-magnetic material, such as a permanent magnet. When an electrical current flows in one direction, a magnetic field 123 is formed, having a polarity to attract magnetic door 122 and thereby creating a force that closes door 122. When the current direction is reversed, the polarity of magnetic field 123 is inverted to repel magnetic door 122 and thereby creating a force that opens door 122.

Figure 14A:
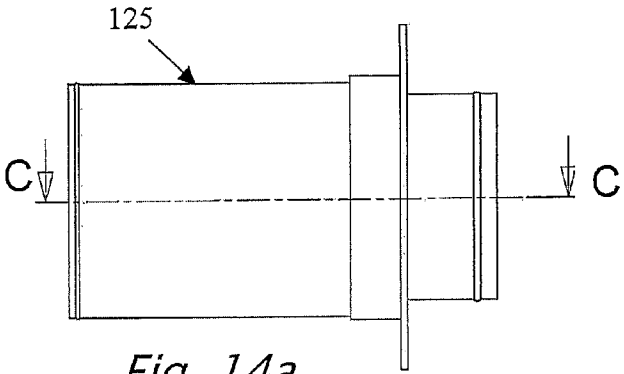
FIG. 14*a* is a top view illustration of an electric valve assembly of a toilet bowl system, according to embodiments of the present invention.
Figure 14B:
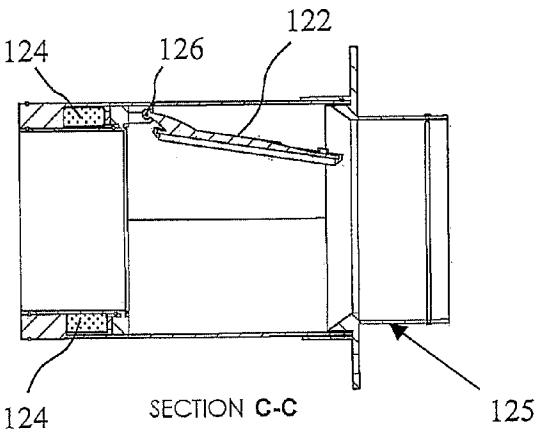
FIG. 14*b* is a cross section illustration of an electric valve assembly of a toilet bowl system, according to embodiments of the present invention, whereas the door is in a partially open state.
Figure 13A:
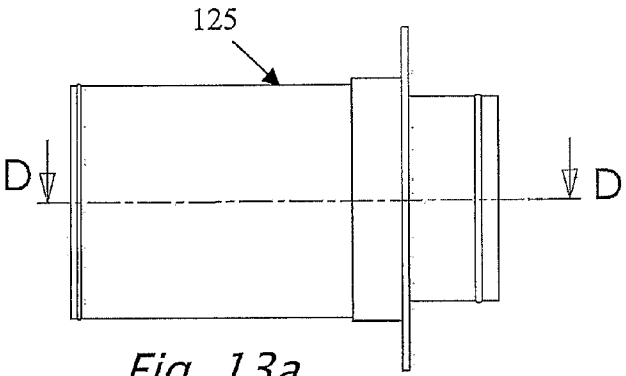
FIG. 13*a* is a top view illustration of an electric valve assembly of a toilet bowl system, according to embodiments of the present invention.
Figure 13B:
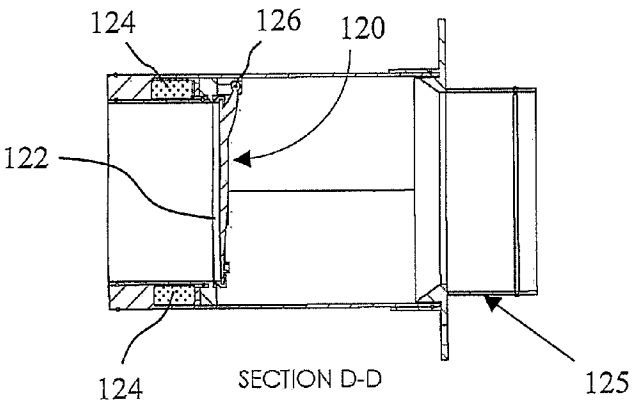
FIG. 13*b* is a cross section illustration of an electric valve assembly of a toilet bowl system, according to embodiments of the present invention, whereas the door is in a close state.

Reference is also made to FIGS. 13*a*, 13*b*, 14*a* and 14*b*. FIG. 13*a* is a top view illustration of an electric valve assembly 120 of a toilet bowl system 100, according to embodiments of the present invention. FIG. 13*b* is a cross section D-D illustration of electric valve assembly 120 shown in FIG. 13*a*, whereas door 122 is forced to close by the magnetic field induced by coil 124. FIG. 14*a* is a top view illustration of an electric valve assembly 120 of a toilet bowl system 100, according to embodiments of the present invention. FIG. 14*b* is a cross section C-C illustration of electric valve assembly 120 shown in FIG. 14*a*, whereas door 122 is forced to open by the magnetic field induced by coil 124.

In embodiments of the present invention, electric valve assembly 120 further includes a gasket 127, which is made of a para-magnetic material, such as steel. Gasket 127 keeps door 122 closed in the presence of force exerted by a standing column of water of certain height present in the toilet bowl. When the force exerted by the standing column of water present in the toilet bowl exceeds some threshold value, door 122 will open to release the water into the sewage.

In embodiments of the present invention, the portion of door 122 that is closer to axis 126 is made of non-magnetic material and the portion of door 122 that is distal from axis 126 is made of ferro-magnetic material.

In embodiments of the present invention, controller 130 of toilet bowl system 100 includes enabling a user to set one or more system parameters, such as electric valve and spigot opening times, using wireless communication between main controller 130 and a remote control device.

The invention being thus described in terms of embodiments and examples, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A toilet bowl, flush system comprising:

(a) a toilet bowl in fluid communication with an external, pressurized water supply and an external sewage system;

(b) an electric spigot configured so as to feed flush water into said toilet bowl from the external, pressurized water supply when actuated to open;

(c) an electric valve configured to allow the flush water and waste products to be discharged from, said toilet bowl into the external sewage system when actuated to open, said electric valve including:

(i) a door made at least partially of a Ferro-magnetic material, said door being kept magnetically closed in the presence of force exerted by a standing column of water of certain height present in the toilet bowl, and when the force exerted by said standing column of water exceeds a threshold value said door being opened and releasing the water into the sewage; and (ii) a coil for attracting and repelling said door in accordance with a direction of an electric current flowing in said coil;

and (d) a control unit configured to regulate actuation of said electric spigot and said electric valve.

2. The device of claim 1, further including a remote control device in wireless communication with said control unit, said remote control device being configured to enable a user to set at least one operational parameter of said control unit.

3. A method for flushing a toilet bowl, the method comprising the steps of:

(a) actuating an electric spigot to allow flush water from an external, pressurized water supply to feed into a toilet bowl when; and (b) actuating an electric valve to allow the flush water and waste materials deposited in said toilet bowl to drain into an external sewage system, said electric valve including:

(i) a door made at least partially of a ferromagnetic material, said door being kept magnetically closed in the presence of force exerted by a standing column of water of certain height present in the toilet bowl, and when the force exerted by said standing column of water exceeds a threshold value said door being opened and releasing the water into the sewage; and (ii) a coil for attracting and repelling said door in accordance with a direction of an electric current flowing in said coil.

4. The method of claim 3, further comprising:

(c) actuating said electric valve to close, thereby blocking flush water to be fed into said toilet bowl from draining into the external sewage system so that the flush water remains in said toilet bowl between flushes.

5. The method of claim 3, wherein the step of actuating an electric valve to open commences after the step of actuating said electric spigot to open so that the flush water is delayed in said toilet bowl prior to draining into the external sewage system.

6. The method of claim 3, wherein the step of actuating an electric valve to open commences simultaneously with the step of actuating said electric spigot to open so as to enable the flush water fed into said toilet bowl to drain immediately from said toilet bowl into the external sewage system.

7. The method of claim 4, further including a step of remotely setting at least one control parameter of a control unit regulating the steps of actuating an electric spigot to open, and actuating an electric valve to open and to close.

* * * * *

UNITED STATES PATENT AND TRADEMARK OFFICE

CERTIFICATE OF CORRECTION

PATENT NO. : 8,307,470 B2
APPLICATION NO. : 12/446236
DATED : November 13, 2012
INVENTOR(S) : Nir Abadi It is certified that error appears in the above-identified patent and that said Letters Patent is hereby corrected as shown below:

Title page item [73] Assignee should be:
"ABADI, OVED; ASRAF, MIRA; ABADI, NIR; BRAVERMAN-ABADI, MICHAL"

Signed and Sealed this
Twenty-sixth Day of August, 2014

Michelle K. Lee

Michelle K. Lee
*Deputy Director of the United States Patent and Trademark Office*